United States Patent [19]

Sherman

[11] Patent Number: 4,729,182

[45] Date of Patent: Mar. 8, 1988

[54] MAILABLE MOBILE FOR PHOTOGRAPHS AND SIMILAR PLANAR OBJECTS

[76] Inventor: Eli L. Sherman, 2536 North Southport, 1st Floor, Chicago, Ill. 60614

[21] Appl. No.: 879,811

[22] Filed: Jun. 27, 1986

[51] Int. Cl.[4] ..... G09F 7/22

[52] U.S. Cl. ..... 40/124; 40/617; 206/575; 206/492; 206/804

[58] Field of Search ..... 40/124, 617, 613; 206/575, 492, 579, 804; 220/375

[56] References Cited

U.S. PATENT DOCUMENTS

| | | | |
|---|---|---|---|
| 2,573,610 | 10/1951 | Russo | 206/804 |
| 2,616,199 | 4/1950 | Robins | 41/11 |
| 2,644,634 | 7/1953 | Weitzner | 206/804 |
| 2,939,234 | 6/1960 | Hill | 40/617 |
| 3,030,718 | 4/1962 | Kirkman | 40/617 |
| 3,215,337 | 11/1965 | Rosenthal | 206/804 |
| 3,327,419 | 6/1967 | Stanos | 40/20 R |
| 3,673,723 | 7/1972 | Lazar et al. | 40/152.1 |
| 3,797,150 | 3/1974 | Hinckley | 40/124.4 |
| 3,894,684 | 7/1975 | Florey | 229/92.8 |
| 4,244,127 | 1/1981 | Buzzard | 40/152.1 |
| 4,244,511 | 1/1981 | Coleman | 206/492 |
| 4,531,319 | 7/1985 | Saxton | 40/539 |
| 4,567,682 | 2/1986 | Hurxthal | 40/617 |

*Primary Examiner*—Henry E. Raduazo

*Attorney, Agent, or Firm*—Willian Brinks Olds Hofer Gilson & Lione Ltd.

[57] ABSTRACT

A mobile comprised of photographs and like planar objects in combination with a mailer. A plurality of photograph mounts are provided for mounting photographs along a flexible cord. The resulting mobile is collapsed into a small pile and placed in a mailer. The cord is secured to a detachable tab portion of the mailer so that the mobile is readily removed from the mailer for immediate display through detachment of the detachable tab portion. The photograph mounts used further permit selection of either a vertical or horizontal mounting of the photographs, and accommodate photographs of different size.

7 Claims, 9 Drawing Figures

SEAL FACE TO FACE
FOLD HERE
FOLD SECOND
FOLD FIRST
FOLD THIRD

MAILABLE MOBILE FOR PHOTOGRAPHS AND SIMILAR PLANAR OBJECTS

FIELD OF THE INVENTION

This invention is related to mobiles, and is particularly directed to a mailable mobile in which photographs or similar planar objects can be collapsed and placed within a mailer in a stacked storage configuration as well as suspended and displayed in a display configuration.

BACKGROUND OF THE INVENTION

The present invention was conceived of by the inventor as satisfying a need for a means to display a number of photographs in a mobile that can be easily assembled by an ordinary person, packed in a mailer, and then readily displayed by the recipient of the mailer.

The concept of a mobile for displaying photographs is, by itself, not new. U.S. Pat. No. 4,567,682, for example, shows clamps for holding the photographs, with the clamps attached to a variety of relatively long rigid supports that form the major structure of the mobile. The '682 mobile is quite elaborate, as well as relatively large and bulky, particularly in view of the elongated supports. The photographs are not in a compact arrangement, but rather are spread out and individually suspended from one of the long supports.

A mailable greeting card ornament is also known. A greeting card of this type is shown, for example, in U.S. Pat. No. 2,616,199. The recipient of the '199 mailer opens the envelope, grasps a hook on the ornament, and then pulls the ornament out of the mailer, whereupon it opens to a three-dimensional shape.

The '199 ornament is, of course, not a mobile. The '199 envelope must also be opened before the hook can be located and grasped to remove the ornament.

Thus, while this prior art shows a mobile made up of photographs and a fold-out greeting card ornament, it does not address the concept of a mailable mobile of photographs. More particularly, the aforementioned need for a mailable mobile that is quickly assembled, mailed and then easily removed from the mailer for immediate display remains unfulfilled.

SUMMARY OF THE INVENTION

The present invention comprises a mailable mobile in which photographs or other similar planar objects are selectively mounted in a mobile by a sender, collapsed into a storage configuration, inserted within a mailer, conveniently removed from the mailer by the recipient, and displayed in a display configuration after the mobile is removed from the mailer.

In a present form of the invention, the mailer within which the mobile is received has a detachable tab portion which is attached to the mobile. The tab portion is detached from the mailer by the recipient and then used to withdraw the mobile from the mailer. The detached tab portion is then used to hang the mobile for display.

A contact adhesive is advantageously provided on the tab portion which is exposed when the tab is removed. The contact adhesive is then used in adhering the tab to a surface for promptly hanging the mobile. Formation of the mailer is also facilitated by a color-coded folding arrangement.

The mobile of this invention further permits the assembler to select either a vertical or horizontal mounting of photographs between a set of photograph clamps.

This feature also accommodates photographs of different size.

The foregoing features and advantages of the present invention will be more readily understood upon consideration of the following detailed description of a present embodiment taken in conjunction with the accompanying drawings, in which:

DETAILED DESCRIPTION OF AN EMBODIMENT OF THE INVENTION

Figures 1A, 1B, 2, 3:
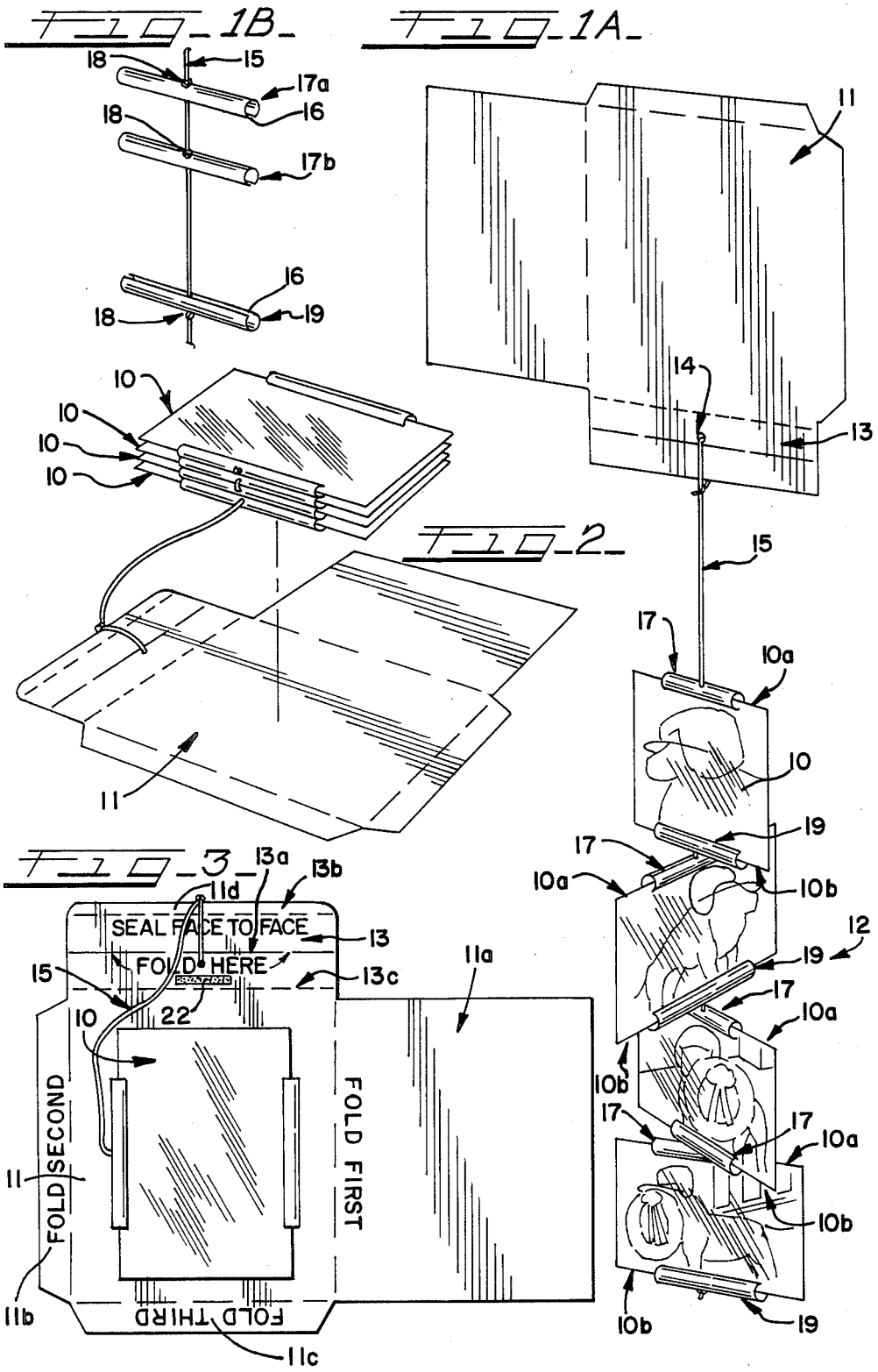
FIG. 1A is a perspective view of an embodiment of a mailable mobile made in accordance with the present invention as it looks prior to folding for mailing.
FIG. 1B is a perspective view of a portion of the mobile detailing the photograph clamps.
FIG. 2 is a perspective view showing the photographs collapsed in a storage configuration for placement in a mailer.
FIG. 3 is a top plan view in which the photographs have been stacked in the mailer.

With reference to FIG. 1A, generally planar objects such as photographs 10, each having a top edge **10*a* and a bottom edge 10*b*, are shown suspended in a mobile 12 from a mailer 11. The mailer 11 has a detachable tab portion 13 which is secured to an elongated flexible member in the form of a cord 15 of transparent monofiliment line. The cord 15 is tied to the detachable tab portion 13 through use of a hole 14 in the tab portion 13**.

As will be discussed in further detail hereafter the tab portion 13 when detached from the mailer 11 is used to mount the mailer in a display configuration with the mobile 12 suspended as shown in FIG. 1A.

A plurality of mounting means in the form of sets of upper photograph clamps 17 and lower photograph clamps 19 are arranged along the cord 15. The cord 15 passes through holes in the approximate center of the upper and lower photograph clamps 17, 19. Each upper photograph clamp 17 holds the top edge **10*a* of a photograph 10 and each lower photograph clamp 19 holds the bottom edge 10*b* of the same photograph 10. The photographs 10 are thereby mounted in the mobile and, when suspended for display as in FIG. 1A**, rotate relative to one another resulting in a visually appealing display.

As best shown in FIG. 1B, the clamps 17, 19 are thin-walled semi-flexible tubular members having an end to end longitudinal slit 16. Edges of a photograph 10 are received in the slits 16. A knot 18 is located exterior to each clamp opposite a respective slit 16. The knots 18 form end stops for the clamps 12, 19 of a set, which are otherwise free to slide. The clamps 17, 19 in a given set have a maximum spacing (knot to knot) that is a sufficient distance to hold a standard size photograph (e.g. 3"×5") therebetween. This distance is preferably slightly less than the height of the photograph so that the photograph is under compression, and thereby firmly fixed between a set of clamps 17, 19.

In FIG. 1A, each photograph clamp set 17, 19 is shown holding a single photograph 10, but it will be understood that two photographs 10 in back-to-back relation may also be held by each clamp set. When such an arrangement is used, the flexible cord 15 passes between the back-to-back photographs 10, and is hidden from view.

FIG. 1B shows a first upper photograph clamp 17*a* and a second upper photograph clamp 17*b*. arranged in combination with a single lower photograph clamp 19 along the flexible cord 15. The second upper photograph clamp 17*b* has an associated knot 18 which is located between the knots of the upper and lower clamps 17*a*, 19. Clamp 17*b* is otherwise permitted to slide along the flexible cord 15. Depending upon the height of the photograph 10 to be mounted, the top edge 10*a* of the photograph 10 can be held by either the first upper photograph clamp 17*a* or the second upper photograph clamp 17*b*. This allows photographs 10 of differing sizes to be mounted in the mobile, thereby giving it further variety and visual appeal. Moreover, it permits a choice between mounting a photograph horizontally or vertically in a set of clamps.

Once the mobile 12 has been assembled, the photographs 10 are then collapsed in a pile in a storage configuration above the mailer 11 (FIG. 2). The pile of photographs 10 is sufficiently compact so that it can be easily accommodated within the mailer 11.

Referring now to FIG. 3, the mailer 11 has a first flap 11*a*, a second flap 11*b*, a third flap 11*c* and a fourth flap 11*d* which fold over the photographs 10 for mailing. A line 13*a* is drawn on fourth flap 11*d* to define the detachable tab portion 13. Perforated segments 13*b*, 13c also provided to facilitate opening of the mailer upon receipt.

Figure 4:
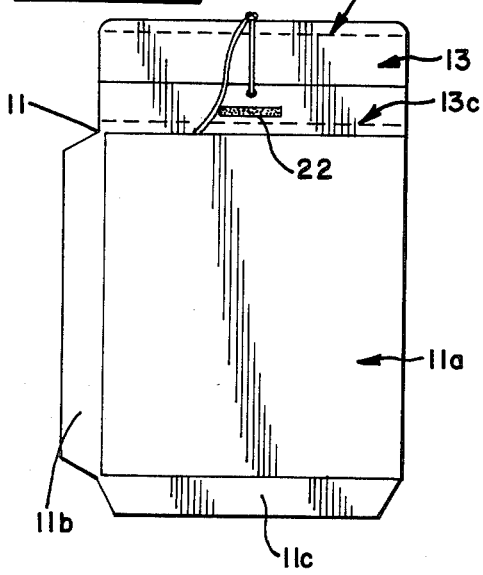
FIGS. 4–7 are views similar to that of FIG. 3, showing how the mailer is folded over the photographs.

FIG. 4 shows the first step of the closing process, in which the first flap 11*a* (shown prior to folding in FIG. 3) of the mailer 11 is folded on top of the pile of photographs 10.

Figure 5:
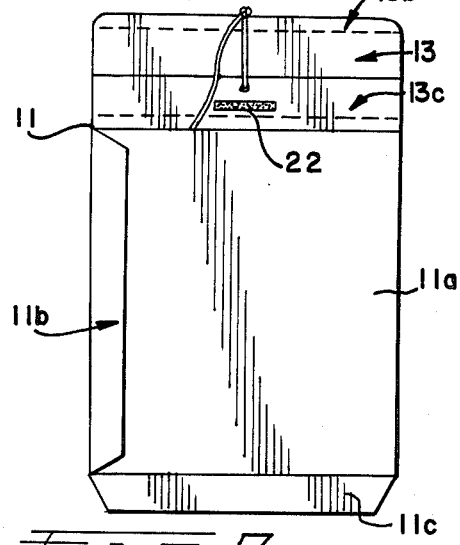

FIG. 5 shows the second step of the closing process, in which the second flap 11*b* of the mailer 11 is folded on top of the first flap 11*a* of the mailer 11. The second flap 11*b* is secured to the first flap 11*a* by a moisture activated adhesive, contact adhesive or the like.

Figure 6:
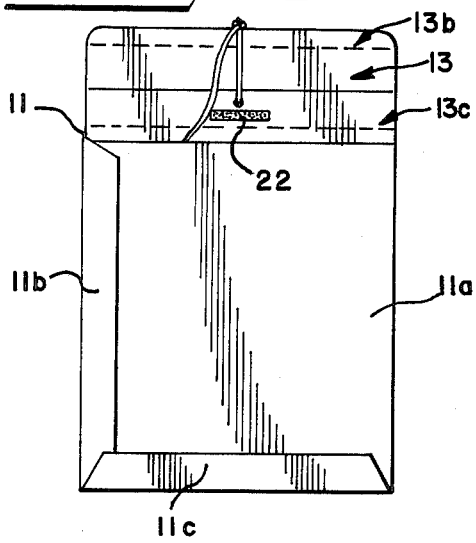

FIG. 6 shows the third step of the closing process, in which the third flap 11*c* of the mailer 11 is folded on top of and adhesively secured to the first flap 11*a*.

Figure 7:
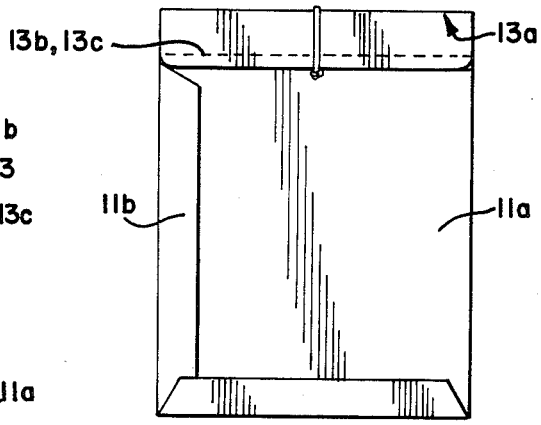

FIG. 7 shows the final step of the closing process, in which the detachable tab portion 13 of the mailer 11 is formed by folding fourth flap 11*d* folded along line 13*a* with a portion of the flap 11*d* adhesively secured to the first flap 11*a*. The two perforated segments 13*b*, 13*c* are brought into approximate alignment by this final fold.

Formation of the mailer can be facilitated by a color coding arrangement of the flaps 11 a–11*d*. For example, flap 11*a* would have a portion colored red, flap 11*b* an orange colored portion, flap 11*c* a yellow colored portion and flap 11*d* a green colored portion. These colored portions would be keyed to written instructions (not shown) indicating how and in what order the flaps are to be folded. The flaps could otherwise be folded without the need for written instruction by simply folding the colored flaps in order according to the visible spectrum, beginning with red. Folding instructions may also be written directly on the flaps, as shown in FIG. 3.

Figure 8:
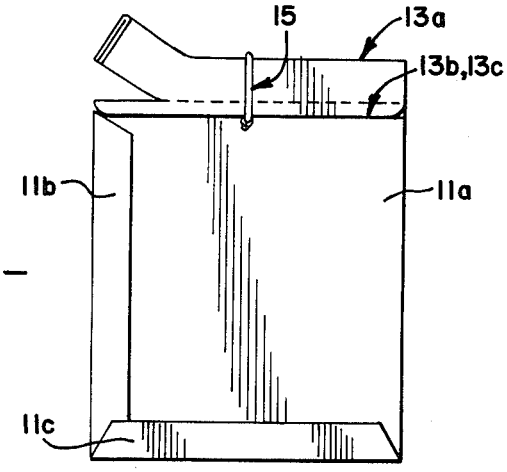
FIG. 8 is a view similar to that of FIG. 7, showing detachment of the tab portion from the mailer.

Upon receipt of the mailer 11, the recipient grasps an end of the detachable tab portion 13 and tears it from the mailer 11 along the tear line formed by the overlapped perforated segments 13*b*, 13*c* (FIG. 8). Since the detachable tab portion 13 is secured to the elongate flexible member 15, the detachable tab portion 13 is then used to pull the photographs 10 from the mailer 11.

In addition, once the photographs 10 have been removed from the mailer, the detachable tab can be used as a hanger to suspend the photographs 10 for display. To this end, a contact adhesive material may advantageously be provided on the flap 11*d* for use in hanging the mobile. For example, a "double sticky" tape 22 may be applied on one half of the tab portion (FIG. 3), with a release paper covering the exposable side of the tape. Once the tab portion 13 is torn from the mailer 11, the folded tab portion will open. The tape 12 can then be used to fix the tab portion to a surface.

While the invention has been described in connection with a certain present preferred embodiment, those skilled in this art will recognize many modifications to structure, arrangement, portions, elements, materials and components which can be used in the practice of the invention without departing from the principles of this invention.

I claim:

1. A mobile for mounting photographs and similar planar objects in combination with a mailer comprising:

an elongate flexible member;

a plurality of photograph mounts located along the flexible member in spaced apart relation, a plurality of photographs when so mounted thereby forming a mobile which can be suspended in a display configuration and can also be stacked fully assembled in a compact rectangular shaped pile in a storage configuration; and a mailer within which the mobile is received and closed in the stacked storage configuration, the mailer having a detachable tab portion to which the flexible member is secured, the detachable tab portion being sized to provide an opening in the mailer through which the stacked mobile is removed from the mailer for immediate display when the detachable tab portion is detached, the detachable tab portion when detached also forming an end to the mobile from which the mobile can be suspended in the display configuration.

2. The mobile and mailer of claim 1 further including adhesive material provided on the detachable tab portion for fixing the tab portion to an object from which the mobile can be suspended in the display configuration.

3. A mobile for photographs and similar planar objects each having a top edge and a bottom edge, in combination with a mailer, comprising:

a flexible cord;

a plurality of sets of upper photograph clamps and lower photograph clamps arranged along the flexible cord, each upper photograph clamp of a set holding the top edge of a photograph and each lower photograph clamp of the same set holding the bottom edge of the photograph, a plurality of photographs when so mounted thereby forming a mobile which can be suspended for display in a display configuration and which can be stacked fully assembled so that the photographs form a pile in a storage configuration; and a mailer having a plurality of flaps, the flaps being adapted to be folded around the mobile in the stacked storage configuration and secured together to close the mailer for mailing, the mailer further having a detachable tab portion secured to the flexible cord, the detachable tab portion being sized to provide an opening in the closed mailer through which the stacked mobile is removed when the detachable tab portion is detached, the detachable tab portion when detached forming an end to the mobile from which the mobile can be suspended in the display configuration.

4. The mobile and mailer of claim 3, in which the plurality of flaps comprise first, second, third and fourth flaps, each of the flaps having an adhesive material along a portion thereof, the flaps being adapted such that the mailer can be secured together and closed by sequential folding and adhesion of the first, second, third, and fourth flaps, and in which the fourth flap has first and second spaced parallel perforated lines that are overlapped upon folding and securement of the fourth flap to thereby form a tear line for the detachable tab portion.

5. The mobile and mailer of claim 3 wherein each of the flaps has a different colored indicia thereon, the indicia being correlated with instructions for folding of the flaps to close the mailer.

6. The mobile and mailer of claim 3 wherein the flaps are adapted to be folded in an ordered sequence to close the mailer, each of the flaps having a different colored indicia thereon selected from the major colors of the visible spectrum, the ordered sequence of closing being correlated with the order of color progression in the spectrum such that the flaps are folded in the order that their respective colored indicia appear in the spectrum.

7. A mobile for photographs and the like, comprising:

a flexible elongated member;

a plurality of sets of photograph clamps located along said flexible member, an edge of a photograph being received and held in a first clamp of a set with an opposite edge of the photograph being received and held in a second clamp of a set, said first and second clamps being in fixed spaced relation in a set, at least one of said sets of photograph clamps further including a third clamp located between said first and second clamps, said third clamp accommodating mounting of a photograph having a height less than the fixed distance between said first and second clamps.

* * * * *